US005713104A

United States Patent [19]

Giampaolo, Jr.

[11] Patent Number: 5,713,104

[45] Date of Patent: Feb. 3, 1998

[54] PNEUMATIC COMPRESSED AUXILIARY IMPLEMENT HANDLE FOR THE MANUALLY IMPAIRED

[76] Inventor: Joseph L. Giampaolo, Jr., 24 Bubenko Dr., Garnerville, N.Y. 10923

[21] Appl. No.: 723,259

[22] Filed: Sep. 30, 1996

[51] Int. Cl.[6] ..... A47B 95/02

[52] U.S. Cl. ..... 16/114 R; 16/110.5; 16/110 R

[58] Field of Search ..... 16/110 R, 110.5, 16/114 R, 116 R, DIG. 12, DIG. 24, DIG. 25; 273/75, 81 R

[56] References Cited

U.S. PATENT DOCUMENTS

| | | | |
|---|---|---|---|
| 3,259,132 | 7/1966 | Katter . | |
| 4,035,865 | 7/1977 | McRae et al. | 16/114 R |
| 4,389,777 | 6/1983 | Landsberer | 30/324 |
| 4,509,228 | 4/1985 | Landsberger | 16/114 R |
| 4,710,063 | 12/1987 | White | 264/45.2 |
| 4,821,417 | 4/1989 | Levine | 30/298 |
| 4,912,861 | 4/1990 | Huang | 36/29 |
| 5,058,279 | 10/1991 | Mars | 30/290 |
| 5,193,246 | 3/1993 | Huang | 16/114 R |
| 5,251,380 | 10/1993 | Craig | 16/110 R |
| 5,355,552 | 10/1994 | Huang | 16/111 R |
| 5,454,380 | 10/1995 | Gates | 128/845 |

*Primary Examiner*—Chuck Y. Mah
*Attorney, Agent, or Firm*—Abelman, Frayne & Schwab

[57] ABSTRACT

An oversized auxiliary handle for use by the manually impaired has a rigid outer cover with a gripping surface and an open end that is provided with a socket for receiving the handle of a conventional implement, such as a knife, fork, toothbrush, or the like. A bladder having a central cavity aligned with the opening is positioned inside the rigid cover. The cover is fitted with an air pump that is manually activated to pressurize the interior of the cover, causing the cavity in the bladder to, directly or indirectly, compress the socket containing the implement handle, and thereby retain the implement in a fixed relationship with respect to the cover.

21 Claims, 3 Drawing Sheets

PNEUMATIC COMPRESSED AUXILIARY IMPLEMENT HANDLE FOR THE MANUALLY IMPAIRED

FIELD OF THE INVENTION

This invention relates to auxiliary implement handles for use by the manually impaired to facilitate their use of conventional eating and cooking implements, writing instruments, toothbrushes, and the like.

BACKGROUND OF THE INVENTION

Individuals suffering from arthritis, amputees who have lost all or part of one or more of their fingers, and those suffering from debilitating diseases often experience difficulty in grasping the handles conventional implements such as eating utensils, a toothbrush, writing implements and the like. A variety of over-sized handles have been disclosed to provide a larger gripping surface for various types of functional implements. Devices providing oversized handles for the manually impaired fall into two general categories: the first is a handle that will receive custom designed functional implements in a secure, mating relationship; the second type of handle is purportedly adapted to receive the handles of existing, conventionally designed implements. As used herein, the term "implement" will be understood to mean commonly used devices such as knives, forks, spoons and other eating and cooking utensils, pens, pencils, combs, toothbrushes, and the like.

An example of the first category is U.S. Pat. No. 4,719,063, which discloses a flexible bag for receiving a rigid foam-forming material that is fitted with a central slot adapted to receive various implements having a uniform custom-designed handle configuration,; in a preferred embodiment the handle is adhesively joined to the cap so that there is no interchangeability.

U.S. Pat. No. 4,509,228 discloses a rubber bladder which can be inflated by means of a manually activated integral air pump which includes a pocket in one end for receiving the handle of an interchangeable implement. When deflated, this device is flat. However, the closed end of the pocket is free to move around inside of the inflated handle in response to the forces applied to the distal end of the implement inserted in the pocket. Furthermore, the degree of inflation required to exert a sufficient force to retain the implement handle in the pocket may cause the external dimensions of the inflated handle to exceed a size that could be used by some individuals having smaller hands.

U.S. Pat. No. 4,035,856 discloses a spherical handle ranging in diameter from 1.5 to 2.0 inches that can be formed of a resilient elastomeric material and provided with a radial slit that is deformable to receive the handle of various implements. Although it is stated in the disclosure that some mechanism must be provided to rigidly secure implements to the sphere, no specific means are shown for accomplishing this result, taking into account the different sizes and configurations of the handles on conventional implements, e.g., knives, forks, toothbrushes, etc.

It is therefore an object of this invention to provide an improved over-sized handle for manually disabled individuals that is capable of receiving the handles of conventional implements required for everyday subsistence.

It is a further object to provide a handle that can receive such implements in the orientation in which they are customarily held in the hand.

It is another important object of this invention to provide an ergonometrically correct handle to facilitate its retention and use by a user having impaired manual capabilities.

Another object of the invention is to provide an oversized handle that is conveniently and easily inflated by means of an integral air pump.

Yet another object of the invention is to provide an inflatable auxiliary handle adapted to receive any of a number of conventionally designed implements that will be held securely in position once inserted into the auxiliary handle so that the functional end of the implement will move in response to the motion of the handle without undue twisting, wobble or give.

It is a further object of the invention to provide a series of auxiliary inflatable handles having a channel that extends from the exterior surface to the interior of the handle, which opening is specifically configured to receive the handle of one or more common implements the cross sections of which implement handles can be defined as generally flat, round, elliptical, rectilinear, or having other geometrical shapes.

SUMMARY OF THE INVENTION

The specific objects mentioned above, and others, are achieved by an auxiliary handle having an exterior configuration that is generally spherically or that of an oblate spheroid, that comprises:

an outer cover made from a rigid, non-expandable material having an easily gripable surface or surface coating, the rigid outer cover having an opening in one end;

an expandable flexible bladder positioned inside of the rigid outer cover, said bladder having a central cavity;

a manually operable air pump and valve communicating with the bladder and extending through the outer cover; and compressible resilient means that form an elongated socket extending from the open end of the rigid outer cover to the interior of the cover, which socket is configured to receive the handle of a conventional implement, said socket being deformable in response to an increase in air pressure in the bladder.

In a preferred embodiment, the rigid outer cover is provided with a plurality of finger depressions, a thumb depression and optionally, a palm depression, that are arrayed to accommodate a right or left-handed user. The exterior surface of the rigid outer cover has a non-slip gripping surface. The non-slip character of the surface of the outer cover can be achieved by the selection of an appropriate polymeric construction material, by incorporating a textured surface obtained by molding or post-treatment, by applying a thin polymeric coating, or by a combination of two or more of these means. The rigid cover is preferably produced as a molded article in a unitary form, or in two or more sections that can be permanently bonded to form a unitary assembly. The outer cover of the oversized handle of the invention is rigid and of sufficient strength to restrain the bladder during its inflation in order that the compressive forces of the inner surface of the bladder are directed inwardly towards the center of the cover.

The rigid outer cover can be produced from any of a variety of impact resistant polymers or co-polymers by injection molding, blow molding, rotational molding, or other methods well-known in the art. The molded outer cover can be produced as a finished article with finger, thumb and palm depressions, a valve aperture and an appropriately textured surface to enhance its non-slip properties.

Suitable rigid molding polymers include polyvinylchloride, either alone or as a co-polymer, styrene, ABS, polyethylene, of either the high or low density type, alone or in combination with other polymers.

The inflatable bladder is configured to closely fit within the open end of the rigid cover. The bladder is inflated by a finger or thumb operated air pump that is positioned on the surface of the rigid cover, preferably in an aperture formed in the cover for receiving the pump. The pump communicates with the interior surface of the bladder and is provided with a pressure belief mechanism to permit the bladder to deflate for removal of the implement handle. The bladder is resilient and can be produced from natural rubber, synthetic rubber-like polymers, or blends of natural and synthetic polymers.

In a first preferred embodiment, the bladder is formed with a central cavity that is aligned with the open end of the rigid cover. Into this cavity in the bladder is inserted a compressible resilient foam core that extends inwardly from the open end of the rigid cover. The foam core is provided with a socket for receiving the implement handle.

In a preferred embodiment, the rear wall of the bladder cavity is joined to the adjacent outer wall of the bladder. By joining these two walls of the bladder, the interior end of the bladder cavity containing the implement handle is prevented from moving, thus increasing the stability of the implement in the auxiliary handle.

The pump is mounted so that the activator for pressurizing the interior of the rigid cover is easily accessible on the outer surface of the cover where it can be depressed by a thumb or finger. The pump includes a pressure release member to relieve the pressure on the bladder to facilitate removal of the implement handle. In one embodiment, the pump also includes an air passage communicating with the interior of the bladder; in another embodiment the valve is fitted to the rigid cover in an airtight sealing relation so that the rigid cover can be pressurized. Suitable valves are known in the art and have been used with athletic footwear such as ski boots, basketball and running shoes, and the like. The construction and operation of such pumps are shown, for example, in U.S. Pat. No. 5,113,599 and U.S. Pat. No. 5,158,767 and the further references cited in those patents. These patents also disclose the materials and construction of bladders used in conjunction with the pneumatic pumps which are suitable for use with this invention. The disclosures of U.S. Pat. Nos. 5,113,599 and 5,158,767 are incorporated herein by reference.

The resilient compressible foam core can be fabricated from an elastomeric polymer such as polyurethane of the open or closed cell type. The foam core can also be produced from molded foamed natural rubber. The foam should be highly resilient so that it returns to its original configuration after the compressive force of the bladder is released when a different implement is to be used. The foam will also be deformed by the insertion of the implement handle into the central cavity, and the cavity should return to its original configuration following removal of the implement handle. The foam core can be molded in the desired configuration for use in the oversized handle, or can be fabricated from a larger block of foam in accordance with methods that are well-known in the art.

The molding process produces a skin which can serve to facilitate assembly and a friction fit or a bonding surface for application of an adhesive to secure the core to the interior surface of the bladder.

The preformed socket for receiving the implement handle can be formed during the molding of the foam core, or the socket can be cut mechanically or by the use of a laser. The socket can also be produced by use of a heated tool having the desired configuration which will melt the foam structure on contact. The use of a heated tool will also produce a skin or film on the interior surface of the cavity which will further serve to increase the tensil strength of the foam and its ability to resist deformation and thereby increase the grip on the handle of the implement which is inserted into the socket. The coefficient of friction between the handle of the implement and the interior of the core socket can be further increased by application of a separate polymeric coating that is applied as a liquid after the socket is formed. Alternatively, a separate pre-formed insert can be bonded to the interior surface of the socket to provide an enhanced frictional fit between the handle of the implement and the lined socket.

In another preferred embodiment the bladder itself is configured to provide the socket for receiving the handle of the implement. The desired configuration of the socket can be produced by molding the bladder as a hollow unitary piece, or by producing the bladder from two or more pieces that are joined, as by adhesive. The socket in the bladder is aligned with the open end of the rigid outer cover. The resilient bladder can be compressed for insertion into the open end of the cover; once inserted, it returns to its original shape to fit closely against the interior surface of the cover. If the cover is formed from two or more sections, the bladder can be appropriately positioned in the cover before the assembly of the cover sections.

In a third preferred embodiment, the bladder comprises a single-walled, tubular structure that is bonded to the open end of the rigid cover and that extends from the open end to the opposite or inside rear wall of the rigid cover. The open end of the bladder at its proximal end confirms in size and shape to the opening in the rigid cover. The bladder is bonded in an air-tight seal to the rim of the opening in the rigid cover, using adhesive, ultrasonic, hot-melt or other methods known in the art. The distal end of the bladder is bonded to the inner surface of the rigid cover to prevent its movement when an implement handle is positioned in the cavity of the bladder. The bladder can be made from polyester or nylon, or a blend, or other materials described above.

In this embodiment, the rigid cover and bladder cooperate to form an air-tight chamber. The bladder of this embodiment responds to the increase in air pressure by expanding and reducing the size of the central cavity. As in the previously described embodiments, the handle of the implement can be held by a socket formed in a foam core, by a socket formed by the bladder or by an elongated socket assembly employed in conjunction with the bladder and/or foam core.

As a further alternative construction, a separate resilient preformed elongated socket assembly insert can be bonded directly to an interior surface cavity formed in the bladder to receive the socket insert. As in the previously described embodiments, the inflation of the bladder causes the walls of the socket to press firmly against the implement handle in response to the pneumatic pressure and thereby securely grip the handle so that the entire auxiliary handle assembly cooperates to securely and accurately control the movement of the implement.

DETAILED DESCRIPTION OF THE INVENTION

Figure 1:
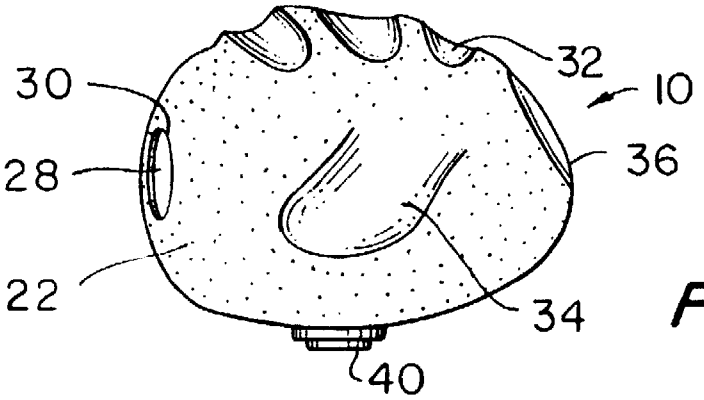
FIG. 1 is a perspective view of an oversized auxiliary handle of the invention.
Figure 3:
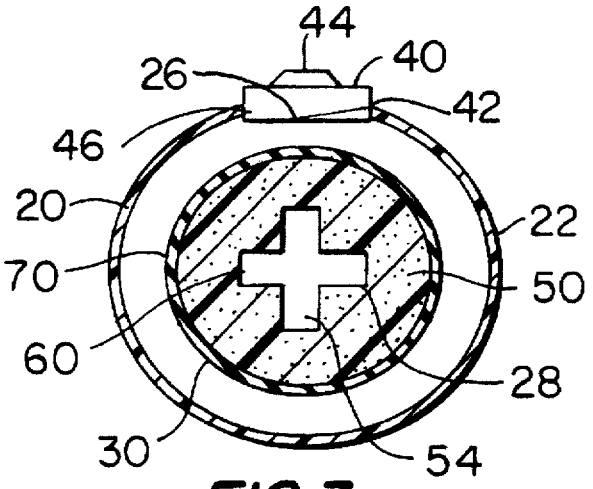
FIG. 3 is an end view of the handle of FIG. 2.

With reference to FIG. 1, the oversized auxiliary handle (10) of the invention is comprised of outer cover (20) having a non-slip exterior surface (22) which is provided with a plurality of finger depressions (32), a thumb depression (34) and a palm depression (36). Air pump (40) is fitted through valve aperture (26). As illustrated in FIG. 3, the outer cover (20) is provided with open end (28) in which the exposed face (54) of foam core (50) can be seen.

Figure 2:
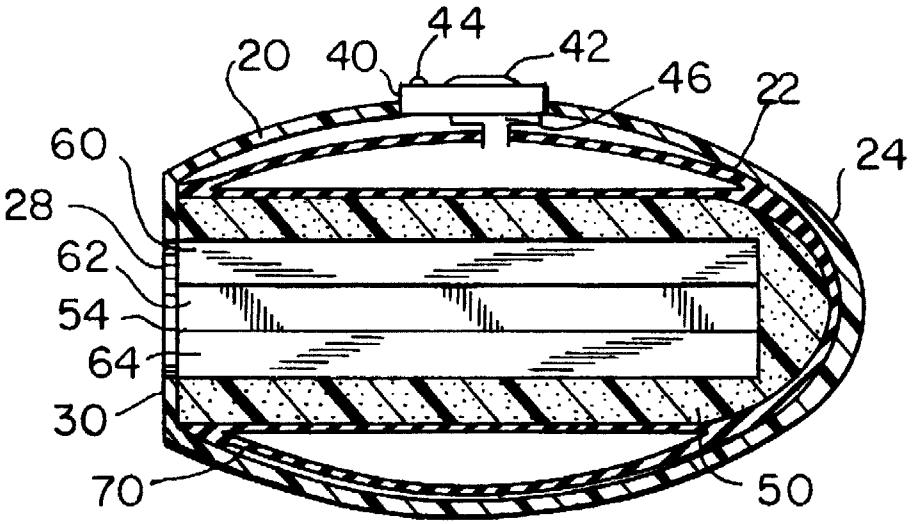
FIG. 2 is a cross-sectional side view of one embodiment of the auxiliary handle of the invention.

As illustrated in the embodiment of FIG. 2, the auxiliary handle outer cover has the shape of a truncated oblate spheroid, or toroid, the maximum diameter of rotation of which can range from about 1.5 to about 2.5 inches. The diameter of rotation D, as shown in the cross-sectional view of FIG. 4 can be varied to accommodate the grip of the user.

The auxiliary handle can also be fabricated in a more nearly spherical configuration (not shown) having a smaller opening (28) at one surface. The principal consideration in choosing the configuration of the rigid cover (20) is to provide an ergonometrically appropriate surface that can be gripped by the user.

Although practical considerations of cost and availability will generally dictate a limited number of configurations and sizes, the shape can be optimized by fitting the outer cover to the specific requirements of the user by use of a custom-made mold. This can be accomplished by using a pliable molding material such as clay or other synthetic deformable material of the approximate size that can be pressed into shape by the intended user. Thus, the precise exterior configuration, including finger, palm and thumb depressions can be created in the pliable molding compound which can then be used as model for producing a mold in which the outer cover is produced. Alternatively, the cover can be produced by machining or otherwise shaping the surface of a preformed outer cover. Such techniques employing computer assisted manufacturing (CAM) devices are well-known in the art.

Figure 4:
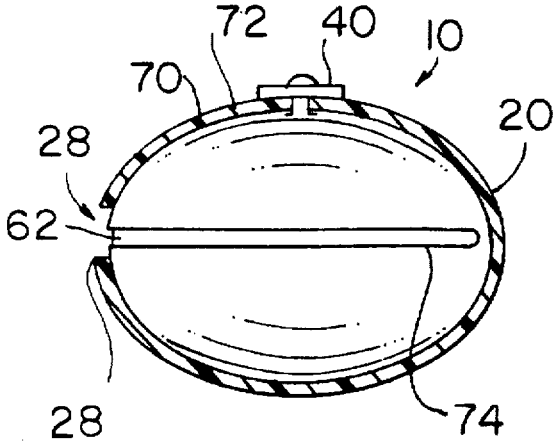
FIG. 4 is a cross-sectional side view of another embodiment of an auxiliary handle of the invention.

The cross-sectional view of FIG. 4 shows the interior surface (24) of rigid cover (20) surrounding bladder (70). The outer layer (72) of the bladder communicates with air pump (40) through passage (46). The inner layer (74) of bladder (70) forms a cavity in the deflated state and is in contact with, and surrounds resilient foam core (50). When pump activator (42) is depressed repeatedly, an increase in air pressure causes bladder (70) to expand inwardly against foam core (50) thereby compressing the foam core uniformly causing the preformed socket to securely engage and retain the inserted implement handle H. Upon movement of pressure release mechanism (44), air is expelled from the bladder, the foam core expands to its original inflated shape and the implement handle H can be removed from the socket.

Figure 5A:
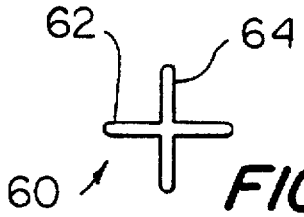
FIGS. 5A, 5B and 5C are end views illustrating various configurations of the socket for receiving implement handles.
Figure 5B:
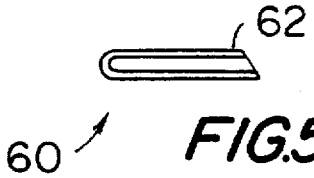
Figure 5C:
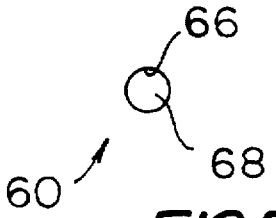
Figure 6:
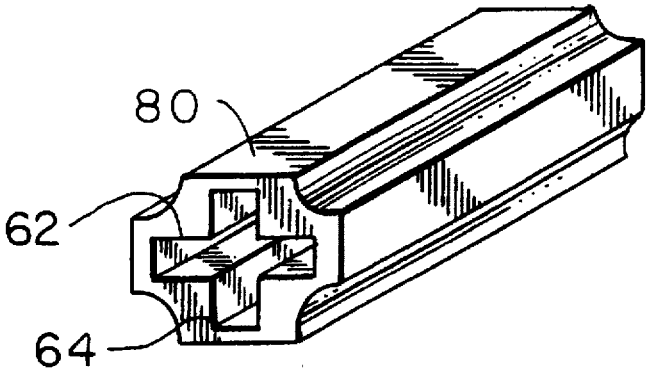
FIG. 6 is a perspective view of one embodiment of a preformed socket insert for use in the invention.

Shown in FIG. 6 is one embodiment of a preformed elongated socket assembly 80 that is configured to fit within a central opening (not shown) of either the foam core 50 of FIGS. 2 and 3 or the cavity of the bladder of FIG. 4. For purposes of illustration, the preformed socket assembled is provided with an axially extending opening formed from intersecting horizontal slot 62 and vertical slot 64. The socket assembly 80 can be conveniently molded from a resilient, readily deformable material, such as natural or synthetic rubber, either solid or foamed. The preformed socket assembly can be provided with any shape of socket opening, and a plurality of socket assemblies can be provided with an auxiliary handle for replacement to accommodate implement handles of differing shapes and/or sizes. Thus, a kit can be provided consisting of an auxiliary handle and a plurality of socket assemblies each having a socket of differing configuration that can be inserted and removed from a position in the foam core or bladder cavity of the embodiments described above. Examples of several particularly suitable socket cross-sections are illustrated in FIGS. 5A, 5B and 5C.

Figure 7:
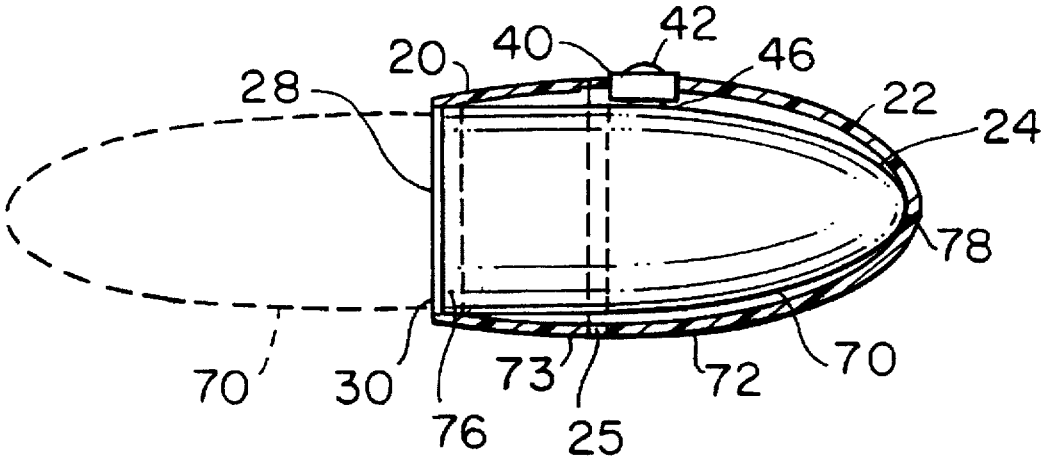
FIG. 7 is a cross-sectional side view of a third embodiment of the invention.

In the third embodiment illustrated in FIG. 7, the rigid cover 20 is molded in two sections that are joined at parting line 25. Bladder 70 is secured in an airtight sealing relation to the rim of open end 28 by means of bladder collar 76. The collar 76 can most conveniently be ultrasonically bonded to the section of the rigid cover before assembly of the two sections. The bladder 70 is shown in phantom as it would appear during bonding; following assembly of the rigid cover sections, which must also be joined in an airtight sealing relationship, the bladder is pushed into the interior of the rigid cover.

The longitudinal dimension of the bladder is sufficient to permit the distal or rear wall of the bladder to contact the interior rear wall of the rigid cover. As shown in FIG. 7, the bladder and cover are joined at their point of contact 78, as for example by epoxy cement. The socket for receiving the implement handle can be provided by any of the means described above. Upon insertion of the handle and activation of the pump, the increasing air pressure in the chamber formed by the rigid cover and bladder causes the bladder to expand inwardly to compress the socket walls against the implement handle.

I claim:

1. An oversized auxiliary handle to facilitate the use of hand-held implements by the manually impaired, the auxiliary handle comprising:

an outer cover made from a rigid, non-expandable material having an easily gripable surface or surface coating, the rigid cover having an opening in one end;

an expandable flexible bladder positioned inside of the rigid cover and extending from the open end into the interior of the cover and terminating proximate a wall of the cover opposite the open end, said bladder joined in an air-tight seal to the cover proximate the open end of the cover to form an air-tight chamber between the bladder and the cover, said bladder having a central cavity aligned with the open end of the cover;

an integral manually operable air pump and valve extending through, and communicating with the interior of the rigid cover for pressurizing said air-tight chamber; and an elongated socket extending from the open end of the rigid cover to the interior of the cover, which socket is configured to receive the handle of a conventional implement, said socket being deformable in response to an increase in air pressure in the air-tight chamber between the bladder and the interior of the rigid cover.

2. The auxiliary handle of claim 1 where the surface of the rigid cover is generally spherical.

3. The auxiliary handle of claim 1 where the surface of the rigid cover has the configuration of an oblate spheroid.

4. The auxiliary handle of claim 1 in which the position of the rear wall of the bladder is fixed with respect to the adjacent rear wall of the rigid cover.

5. The auxiliary handle of claim 1 which further comprises an elongated, resilient, compressible foam core positioned in the cavity of the bladder, said foam core having an exposed face that is aligned with the opening in the rigid cover, and said elongated socket extending through said foam core.

6. The auxiliary handle of claim 5 where the foam core is polyurethane foam.

7. The auxiliary handle of claim 1 where said elongated socket is formed by the walls of the bladder.

8. The auxiliary handle of claim 1 which further comprises a preformed elongated socket assembly in the bladder cavity.

9. The auxiliary handle of claim 1 where the bladder comprises a circular collar that is joined in an airtight seal to the surface of the rigid cover surrounding the open end of the rigid cover.

10. The auxiliary handle of claim 1 where the rigid outer cover is comprised of at least two sections.

11. An oversized auxiliary handle to facilitate the use of hand-held implements by the manually impaired, the auxiliary handle comprising:

(a) a rigid outer cover configured for gripping retention in a partial closed hand, said cover having an open end;

(b) a manually inflatable bladder contained in the rigid outer cover, said bladder having a central cavity opening which is aligned with the open end of the outer cover;

(c) a manually operable pneumatic pump fixedly positioned on the rigid outer cover and communicating with the interior of the bladder for controllably inflating and deflating the bladder;

(d) a resilient compressible foam core positioned in the cavity of the bladder and having a face that is aligned with the open end of the outer cover; and (e) a socket in the face of the foam core, said socket configured to receive the handle of a hand-held implement, said socket extending into the interior of the foam core.

12. The auxiliary handle of claim 11 where the outer cover has a plurality of contoured depressions to aid in manually gripping the auxiliary handle.

13. The auxiliary handle of claim 11 where the outer cover has a non-slip surface treatment.

14. The auxiliary handle of claim 11 where the pneumatic pump is positioned in an orifice in the outer cover.

15. The auxiliary handle of claim 14 where the pump has an integral pressure release means for deflating the bladder.

16. The auxiliary handle of claim 11 where the bladder is bonded to the outer cover.

17. The auxiliary handle of claim 11 where the bladder does not extend into the opening at the end of the outer cover.

18. The auxiliary handle of claim 11 where a portion of the bladder extends into the opening at the end of the outer cover.

19. The auxiliary handle of claim 11 where the resilient foam core is closely fitted into the bladder cavity when the bladder is deflated.

20. An auxiliary handle having a generally spheroidal configuration adapted for gripping by a partially closed hand, said auxiliary handle having a socket for receiving the handle of a conventional implement, the auxiliary handle comprising:

(a) a rigid body member of toroidial surface configuration having an opening at one end of its axis of rotation;

(b) an inflatable bladder closely fitted within the body member, said bladder having a central cavity aligned with the axis of rotation of the body member;

(c) pump means communicating with said bladder;

(d) a flexible, resilient foam core in the bladder cavity; and (e) a socket extending along the axis of the foam core for receiving the handle of a conventional implement, whereby when the bladder is inflated, it compresses the foam core to securely retain the implement handle in the socket.

21. The auxiliary handle of claim 20 where the socket extends through the foam core to communicate with the surface of the bladder, whereby the implement handle contacts the bladder when the handle is fully inserted into the socket.

* * * * *